US005400717A

United States Patent [19]

Hoehn

[11] Patent Number: 5,400,717

[45] Date of Patent: Mar. 28, 1995

[54] MODULAR CONVEYOR TRACK CONNECTION

[76] Inventor: Robert A. Hoehn, 21209 Bittersweet Dr., Shawnee Mission, Kans. 66220

[21] Appl. No.: 123,447

[22] Filed: Sep. 17, 1993

[51] Int. Cl.[6] ..... B61B 3/00

[52] U.S. Cl. ..... 104/89; 104/94; 104/172.4

[58] Field of Search ..... 238/175, 176, 226, 249, 238/250, 251, 252, 262, 151, 246, 247; 104/89, 93, 94, 95, 107, 108, 111, 109; 403/292, 293, 312

[56] References Cited

U.S. PATENT DOCUMENTS

| | | | |
|---|---|---|---|
| 804,989 | 11/1905 | Walker | 238/249 |
| 1,043,570 | 11/1912 | Courson | 238/249 |
| 4,289,274 | 9/1981 | Hudson et al. | 238/249 |
| 4,635,558 | 1/1987 | Hoehn | 104/111 |
| 4,694,531 | 9/1987 | Foy | 104/111 |
| 4,838,412 | 6/1989 | Backman | 104/94 |
| 4,934,276 | 6/1990 | Garpentin et al. | 104/111 |
| 4,967,669 | 11/1990 | Kuchta | 238/249 |
| 5,009,168 | 4/1991 | Kuchta | 238/249 |
| 5,104,040 | 4/1992 | Bormann et al. | 238/249 |

FOREIGN PATENT DOCUMENTS

| | | | |
|---|---|---|---|
| 2131371 | 6/1984 | United Kingdom | 104/111 |
| 8500629 | 2/1985 | WIPO | 104/111 |

OTHER PUBLICATIONS

Prior Art Electric Monorail Track Section, 1 page, no date.

*Primary Examiner*—Mark T. Le
*Attorney, Agent, or Firm*—Chase & Yakimo

[57] ABSTRACT

Track sections of industrial conveyor systems are joined in end-to-end relationship using alignment devices that ensure that the internal running surfaces of the rail flanges of the track are free from irregularities at the track joints. Tubular bushings are located at the ends of the sections on adjacent external surfaces of the rail flanges out of running contact with the moving conveyor components. When the bushings are brought into register and united to form a connection, proper alignment is achieved and maintained without the need to weld the track sections together at each joint. This provides a modular track configuration to facilitate the installation and maintenance of conveyor track systems.

5 Claims, 2 Drawing Sheets

MODULAR CONVEYOR TRACK CONNECTION

BACKGROUND OF THE INVENTION

This invention relates to improvements in the installation and joining of end-to-end track sections of industrial conveyor systems employing track sections of low tolerance construction and, in particular, to a modular track configuration employing end connections which ensure proper alignment of the running surfaces of the end-to-end sections.

Conventional power and free conveyor systems utilize a track formed by end-to-end straight, curved, dip and special track sections that are typically joined by flange couplings at their abutting ends which must be welded together to form a permanent joint. In an overhead power and free conveyor, for example, the power track is provided by a steel I-beam mounted above and coextensive with a pair of opposed channel iron members. The I-beam, often referred to as the power rail, supports the drive trolleys and drive chain with the opposed channel members forming a track which supports the free trolleys and associated load-bearing carrier assemblies. In a typical installation these track sections are suspended from overlying main beams of the superstructure of the building in which the conveyor is installed as, for example, disclosed in U.S. Pat. No. 4,635,558.

Both the I-beams and the channel members providing the power track and the free track, respectively, are formed from hot rolled steel with manufacturing tolerances on the order of $\pm\frac{1}{8}$ inch. Accordingly, it is often difficult to precisely align the running surfaces of the track sections at a joint and, once alignment is achieved, hold the sections in proper alignment. As a result, the conventional installation technique employs coupling flanges at the joints which are initially bolted together to hold the track members once they are aligned, followed by welding the coupling flanges together to preclude movement (and attendant misalignment) that could otherwise occur due to vibration of the tracks during operation of the conveyor system. Therefore, installation heretofore has been very labor intensive due to the need to adjust for misalignment caused by wide manufacturing tolerances and the expense of welding the bolted flanges at the track joints.

SUMMARY OF THE INVENTION

It is, therefore, the primary object of the present invention to provide a track connection for the track sections of conveyor systems which ensures alignment of the running surfaces of the track and provides a secure, weldless connection.

As a corollary to the foregoing object, it is an important aim of this invention to enable modular track construction in industrial conveyor systems by providing track sections with compatible end connections.

Another important object of this invention is to provide the ends of such track sections with an alignment device which, in installing the track sections, will automatically establish correct alignment of the running surfaces of the end-to-end sections so that variation in track section configuration, caused by low manufacturing tolerances, will not create an irregularity in the running surface.

Still another important object of this invention is to provide an alignment device as aforesaid located closely adjacent the running surfaces of the track sections so that movement of the running surfaces to a misaligned condition is precluded without the need to weld the track sections together.

Yet another important object of the invention is to provide such an alignment device in cooperation with a flange coupling at the abutting ends of the track sections to secure the track sections in end-to-end relationship without the need to weld the coupling flanges together.

Furthermore, it is an important object of this invention to provide such an alignment device that employs tubular elements on respective abutting ends which, when brought into axial registration, establish correct alignment of the running surfaces, such alignment being maintained by insertion of a pin through the elements to unite the same in register.

Additionally, particularly in power and free conveyor systems, it is an object of this invention to locate the alignment elements out of interference with a moving trolley but closely adjacent to the internal running surfaces presented by the rail flanges of the I-beam and channel member tracks of the system, such as on the lower surface of the I-beam flange or the proximal end of the channel flange.

Other objects will become apparent as the detailed description proceeds.

DETAILED DESCRIPTION

Figure 1:
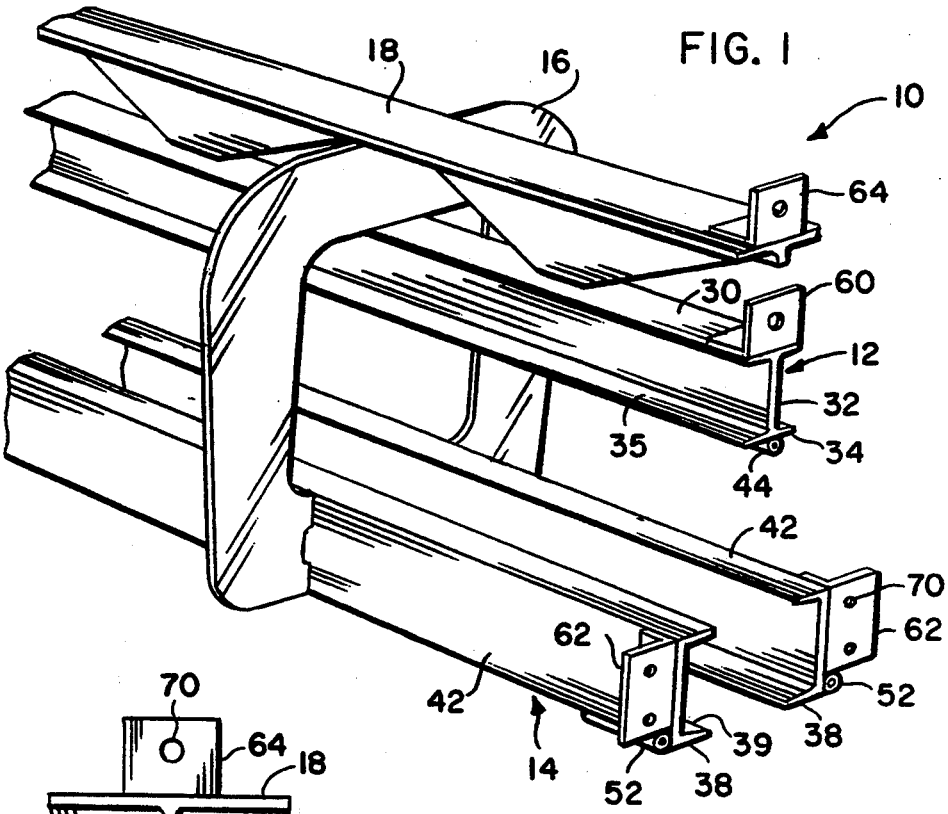
FIG. 1 is a perspective view of a portion of a track section of a power and free conveyor system, showing the end of the section in the foreground prior to connection with an adjacent track section.
Figure 4:
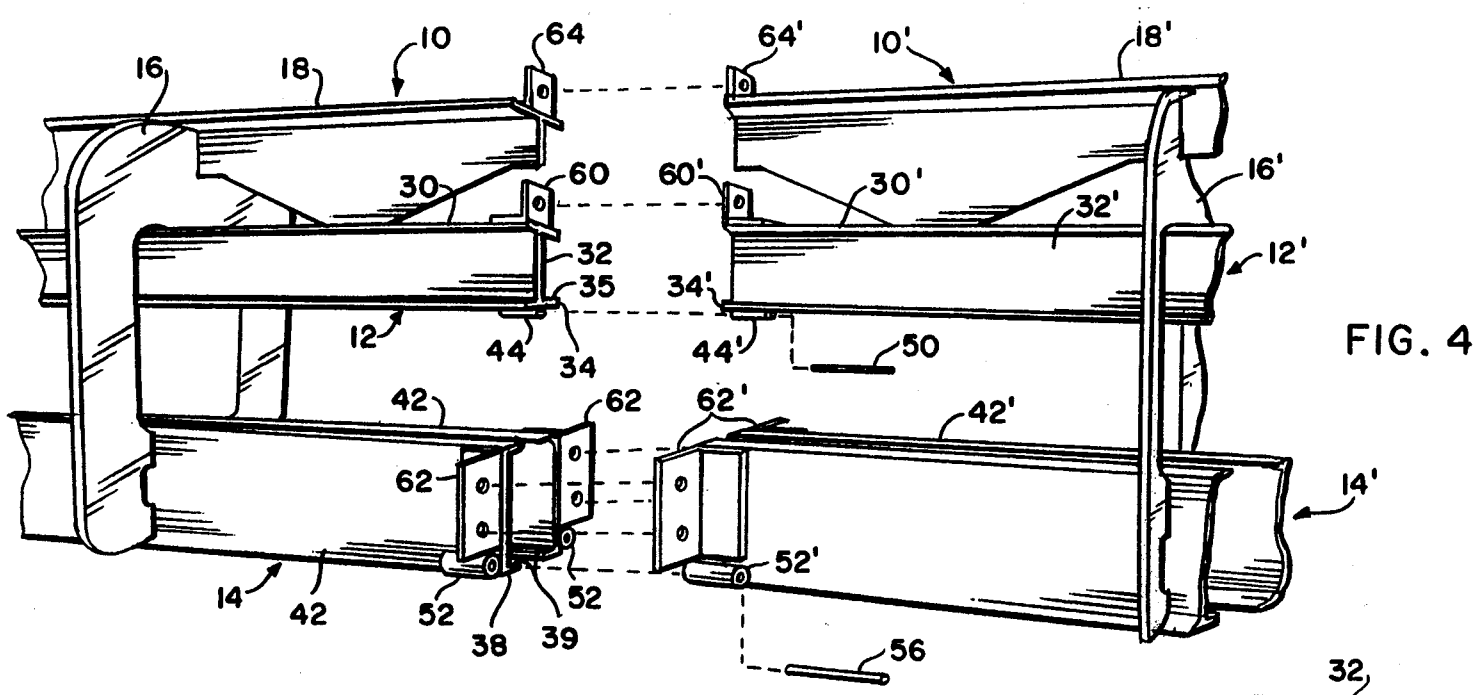
FIG. 4 is a fragmentary, exploded, perspective view showing the abutting ends of track sections that are to be joined.

FIG. 1 shows a portion of a track section 10 of an overhead power and free conveyor, section 10 and a second track section 10' (FIGS. 4 and 5) having a configuration known in the art and described in detail in the aforesaid U.S. Pat. No. 4,635,558. Track sections 10, 10' are representative of long span sections of uniform length (approximately 30 feet or 9 meters) that are joined in end-to-end relationship to provide the power and free tracks of a particular conveyor system.

The conventional components of track section 10, it being understood that section 10' is identical thereto, comprise an I-beam power rail 12, a free trolley track 14, a yoke plate 16 suspending the free track 14 below the power rail 12, and a reenforcing rail cap 18 of the type disclosed in U.S. Pat. No. 4,635,558. It will be understood that the views herein are fragmentary and that, therefore, there are a plurality of yoke plates 16 spaced longitudinally along each track section.

Figure 5:
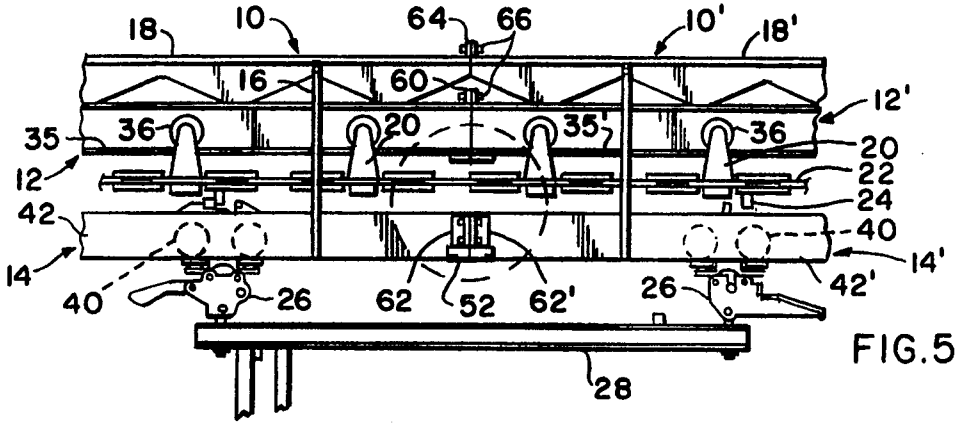
FIG. 5 is a fragmentary, elevational view of the interconnected track sections on a reduced scale and illustrates a power and free conveyor thereon.

The power rail 12 provides a track for the power trolleys 20 (FIG. 5) of the conveyor system, trolleys 20 carrying a conveyor chain 22 from which pusher dogs 24 depend for engagement with free trolleys 26 on the free track 14 in the usual manner. FIG. 5 illustrates a load-bearing carrier bar 28 extending from the front trolley 26 to the rear free trolley 26 shown.

The I-beam power rail 12 has an upper flange 30, a vertical web 32 and a lower flange 34, the latter providing a horizontally projecting rail flange presenting upper surfaces 35 on both sides of web 32 upon which rollers 36 (FIG. 5) of the power trolleys 20 run. Similarly, a pair of spaced, lower horizontal flanges 38 of the free track 14 present running surfaces 39 for the wheels 40 (FIG. 5) of free trolleys 26. Flanges 38 are the lower flanges of a pair of confrontingly aligned channel members 42 that comprise the free track 14.

When the track sections 10, 10' are joined in end-to-end relationship to form a continuous piece of track, the connections at the abutting ends of adjacent sections must both rigidly interconnect the sections and maintain the running surfaces 35, 35' and 39, 39' in correct, coplanar alignment. Any misalignment causes an irregularity or bump which will be encountered by the trolleys as they traverse a misaligned joint. Proper alignment is ensured in the present invention by the use of alignment elements and mating connectors as will be described, in conjunction with coupling members that are bolted together to form a weldless connection.

Figure 3:
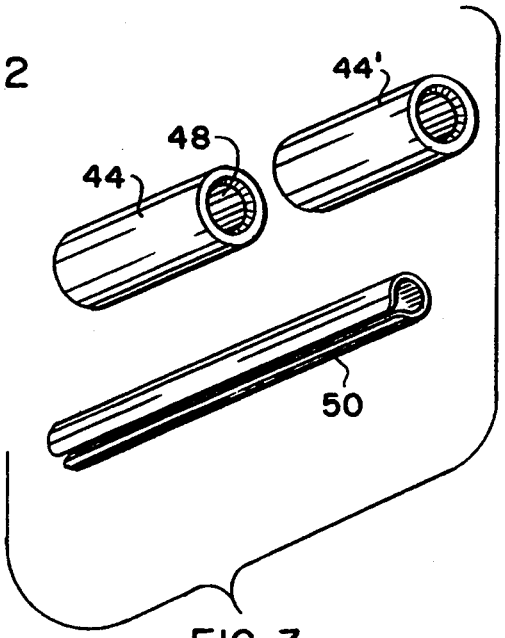
FIG. 3 is an enlarged, exploded, detail view showing two alignment bushings in register and illustrating the pin that unites the bushings.
Figure 6:
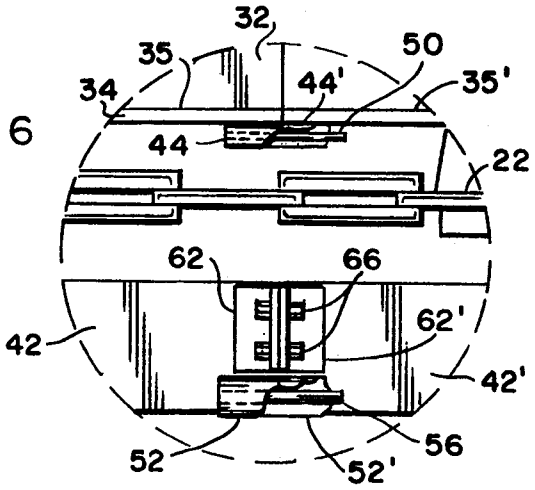
FIG. 6 is a detail at the joint circumscribed by the broken line circle in FIG. 5.

Pursuant to the teachings of the present invention, a tubular bushing 44 is located on the downwardly facing, external surface 46 of the lower flange 34 of I-beam 12 and is welded in place at the center of the flange directly beneath the web 32. The bushing 44 has an axial opening 48 therethrough (FIG. 3) which extends in longitudinal alignment with the track section. Likewise, track section 10' has an identical bushing 44' at the abutting end of its I-beam 12', both of such bushings receiving a spring pin 50 when the bushings 44, 44' are in register with each other and the track ends are brought into engagement. This condition is illustrated in FIG. 6 where it may be seen that the pin 50 has been partially inserted.

Figure 2:
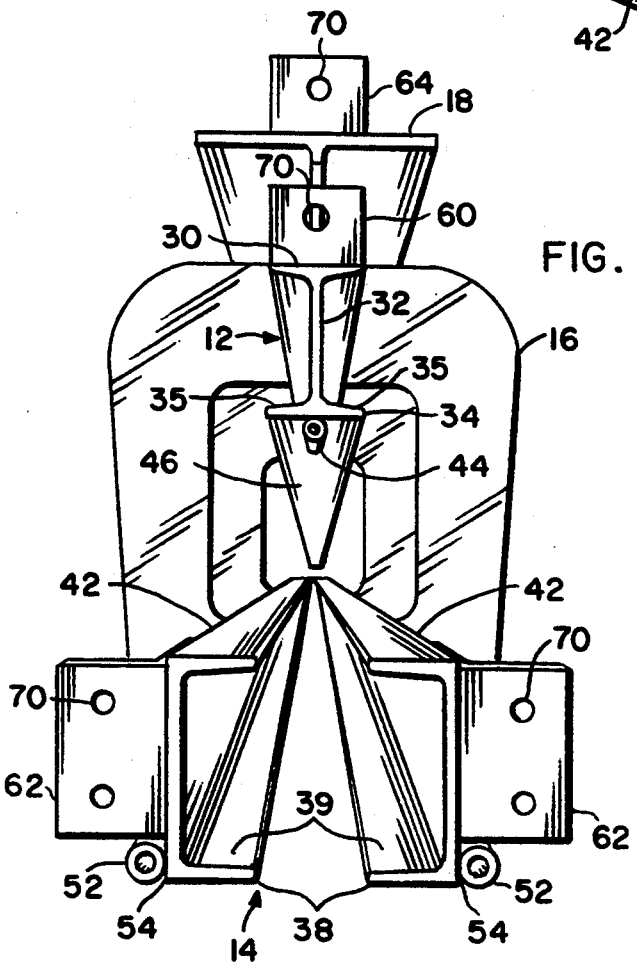
FIG. 2 is a perspective view of the track section shown in FIG. 1, looking at the end of the section seen in the foreground in FIG. 1 and revealing the alignment bushings and coupling flanges.

In similar fashion, a pair of tubular bushings 52 are located on respective external surfaces 54 of channel members 42 at the proximal ends of flanges 38 as best seen in FIG. 2. These bushings 52 are also welded in place with their axes in parallelism and aligned with the longitudinal run of the track section. At the joint illustrated herein, bushings 52 are united with corresponding bushings 52' on track section 10' by spring pins 56 in the same manner as described above for bushings 44, 44'. Bushings 44 and 52, and pins 50 and 56 are identical except for sizing as illustrated, and are also provided at the opposite ends of sections 10, 10' not shown in the drawings.

It should be understood that special attention is given to the placement of bushings 44, 52 during fabrication of the track sections. As discussed hereinabove, the I-beams 12 and channel members 42 may vary significantly in cross-sectional dimension due to low manufacturing tolerances. Therefore, each bushing 44, 52 is located on an individual track member at the same position relative to the running surface 35 or 39 so that any pair of fabricated track sections, when brought into end-to-end relationship, will be in proper alignment when the pairs of alignment bushings are in register.

Additionally, an angle member 60 is welded to the upper flange 30 of I-beam 12 at the end thereof, it being understood that an identical angle member is likewise welded at the opposite end of track section 10 not shown in the drawings. A pair of angle members 62 are welded to the respective channel members 42 just above the bushings 52, and an angle member 64 is welded to the end of the rail cap 18. These angle members present coupling flanges which are bolted together in the usual manner as illustrated by the bolt/nut combinations 66 seen in FIG. 6 interconnecting an abutting pair of members 62, 62'.

The present invention provides a modular track configuration in view of the end connections employed. Each of the track sections 10, 10' etc. is interchangeable in assembly since all of the end connections are compatible. Once two track sections, such as 10 and 10' illustrated herein, are brought into end-to-end relationship, insertion of the pins 50 and 56 into the axially aligned bushings 44–44' and 52–52' automatically ensures that the running surfaces 35, 35' and 39, 39' will likewise be in proper alignment. By locating the bushings on external surfaces 46 and 54 that are closely adjacent to the running surfaces, but out of running contact with the trolleys, the running surfaces are effectively held and resist any tendency to shift to a misaligned condition.

Once the pins 50, 56 are in place, the bolts 62 that interconnect the coupling flanges 60, 62 and 64 may be tightened and the connection is complete. It should be understood that the bolt holes (such as seen at 70 in FIG. 2) are purposely enlarged relative to the bolts so as to allow for proper positioning of the aligned bushings and insertion of the pins before the bolts are tightened to provide a permanent joint.

Having thus described the invention, what is claimed as new and desired to be secured by Letters Patent is as follows:

1. In a conveyor system:

a pair of end-to-end track sections presenting abutting ends, each of said sections having a rail flange presenting an upwardly facing, internal running surface for a moveable component of the conveyor system and an adjacent external surface out of running contact with said component, an alignment element rigidly affixed to the abutting end of each of said sections respectively, said elements being located on the external surfaces of respective flanges at predetermined relative positions and having means establishing correct alignment of the running surfaces of the sections when the elements are united in register with each other, a mating connector engaging said elements at said relative positions thereof to unite the elements in register and hold the running surfaces in correct alignment, and coupling means interconnecting said sections at said abutting ends to secure the sections in end-to-end relationship with said united elements maintaining said alignment of the running surfaces.

2. The combination as claimed in claim 1, wherein said coupling means includes coupling members on said abutting ends of the sections and bolt means engaging said members, whereby to provide a weldless joint interconnecting said sections, in proper alignment.

3. The combination as claimed in claim 1, wherein each of said elements is tubular and has an axial opening extending generally longitudinally of the corresponding track section and presenting said alignment establishing means, said mating connector comprising pin means received within said axial openings of the elements when the elements are axially aligned with each other.

4. In a power and free conveyor system:

a power track for carrying power trolleys of the conveyor system, a free track for carrying free trolleys of the conveyor system, structure securing said power and free tracks in vertically spaced relationship, said tracks including end-to-end track sections presenting abutting ends, each of said sections having a rail flange presenting an upwardly facing, internal running surface for a trolley of the conveyor system and an adjacent external surface out of running contact with said trolley, alignment elements rigidly affixed to the abutting ends of said track sections, said elements being located on the external surfaces of said flanges at predetermined relative positions and having means establishing correct alignment of the running surfaces of the track sections when each pair of said elements on the abutting ends of adjacent sections is united in register, mating connectors engaging corresponding pairs of said elements at said relative positions thereof to unite the elements in register and hold the respective running surfaces in correct alignment, and coupling means interconnecting said track sections at said abutting ends thereof to secure the sections in end-to-end relationship with said united elements maintaining said alignment of the running surfaces.

5. The combination as claimed in claim 4, wherein each of said elements is tubular and has an axial opening extending generally longitudinally of the respective track section and presenting said alignment establishing means, each of said mating connectors comprising pin means received in the axial openings of an aligned pair of said elements to unite the elements in register and hold the running surfaces in correct alignment.

* * * * *